US010513962B2

(12) United States Patent
Wehler et al.

(10) Patent No.: US 10,513,962 B2
(45) Date of Patent: Dec. 24, 2019

(54) MODULAR EXHAUST GAS TREATMENT DEVICE FOR AN EXHAUST GAS SYSTEM OF AN INTERNAL COMBUSTION ENGINE

(71) Applicant: MTU FRIEDRICHSHAFEN GMBH, Friedrichshafen (DE)

(72) Inventors: Klaus Wehler, Friedrichshafen (DE); Guido Schäffner, Horgenzell (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 15/303,360

(22) PCT Filed: Mar. 6, 2015

(86) PCT No.: PCT/EP2015/000509

§ 371 (c)(1),
(2) Date: Oct. 11, 2016

(87) PCT Pub. No.: WO2015/154839

PCT Pub. Date: Oct. 15, 2015

(65) Prior Publication Data

US 2017/0037761 A1 Feb. 9, 2017

(30) Foreign Application Priority Data

Apr. 10, 2014 (DE) ..... 10 2014 005 303

(51) Int. Cl.
*F01N 3/02* (2006.01)
*F01N 3/08* (2006.01)
(Continued)

(52) U.S. Cl.
CPC ..... *F01N 3/2892* (2013.01); *F01N 3/0237* (2013.01); *F01N 13/017* (2014.06);
(Continued)

(58) Field of Classification Search
CPC .... F01N 3/0211; F01N 3/2839; F01N 13/011; F01N 13/017; F01N 13/18; F01N 2450/30; F01N 2470/08
See application file for complete search history.

(56) References Cited

U.S. PATENT DOCUMENTS 7,918,914 B2 4/2011 Sudmanns et al.
8,747,788 B1 6/2014 Baig et al.
(Continued)

FOREIGN PATENT DOCUMENTS

CN 101487408 A 7/2009
CN 101487408 B 6/2013
(Continued)

OTHER PUBLICATIONS

"Enclose," Merriam-Webster.com, retrieved Nov. 8, 2018 (Year: 2018).*

*Primary Examiner* — Audrey K Bradley
(74) *Attorney, Agent, or Firm* — Lucas & Mercanti, LLP; Klaus P. Stoffel

(57) ABSTRACT

An exhaust gas treatment device for an exhaust gas system of an internal combustion engine, including a housing which has at least two equivalently formed receiving elements for arranging the AGN modules, and at least one exhaust gas guide module which is inserted into one of receiving elements, and an exhaust gas guide module for an exhaust gas treatment device of this type.

8 Claims, 4 Drawing Sheets

(51) Int. Cl.

| | |
|---|---|
| ***F01N 3/28*** | (2006.01) |
| ***F01N 13/18*** | (2010.01) |
| ***F01N 3/023*** | (2006.01) |
| ***F01N 13/00*** | (2010.01) |
| *F01N 3/021* | (2006.01) |

(52) U.S. Cl.

CPC ..... *F01N 13/18* (2013.01); *F01N 3/021* (2013.01); *F01N 3/0211* (2013.01); *F01N 3/08* (2013.01); *F01N 3/2839* (2013.01); *F01N 13/011* (2014.06); *F01N 2240/20* (2013.01); *F01N 2450/30* (2013.01); *F01N 2470/08* (2013.01)

(56) References Cited

U.S. PATENT DOCUMENTS

| | | | |
|---|---|---|---|
| 9,011,782 | B2 | 4/2015 | Baig et al. |
| 2013/0152555 | A1 | 6/2013 | Bui |

FOREIGN PATENT DOCUMENTS

| | | | | | |
|---|---|---|---|---|---|
| DE | 10331693 | A1 | | 2/2005 | |
| DE | 102007002556 | A1 | | 7/2008 | |
| DE | 102010028293 | A1 | | 11/2011 | |
| DE | 102010027293 | A1 | * | 1/2012 | ..... F01N 3/0211 |
| DE | 102013012336 | A1 | | 2/2014 | |
| DE | 102014000961 | A1 | | 7/2014 | |
| DE | 102013015602 | A1 | * | 3/2015 | ..... F01N 3/106 |
| EP | 1498586 | A1 | * | 1/2005 | ..... F01N 3/0211 |

* cited by examiner

MODULAR EXHAUST GAS TREATMENT DEVICE FOR AN EXHAUST GAS SYSTEM OF AN INTERNAL COMBUSTION ENGINE

The present application is a 371 of International application PCT/EP2015/000509, filed Mar. 6, 2015, which claims priority of DE 10 2014 005 303.2, filed Apr. 10, 2014, the priority of these applications is hereby claimed and these applications are incorporated herein by reference.

BACKGROUND OF THE INVENTION

The invention relates to an exhaust gas aftertreatment device for an exhaust gas system of an internal combustion engine, and to an exhaust gas guiding module for such an exhaust gas aftertreatment device.

SUMMARY OF THE INVENTION

According to the invention, an exhaust gas aftertreatment device for an exhaust gas system of an internal combustion engine is proposed, with a housing which has at least two receptacles of equivalent design for the arrangement of AGN modules, and with at least one exhaust gas guiding module which is inserted into one of the receptacles. As a result, the exhaust gas guiding module can be inserted into any of the receptacles which is provided for the AGN modules, as a result of which an exhaust gas guide can be flexibly adapted to different requirements. An "exhaust gas guiding module" is intended to be understood here as meaning in particular a module which is provided only in order to guide an exhaust gas flow. By contrast, an "AGN module" is intended to be understood as meaning a module which is provided for guiding at least part of the exhaust gas flow and which has at least one substrate which is relevant for an exhaust gas aftertreatment, in particular for cleaning the exhaust gas, such as, for example, a DPF or SCR module through which the exhaust gas flow is guided. A "module" is intended to be understood here as meaning in particular a unit with one or more components which are fixedly connected to one another, said unit being provided in order to be mounted in one installation step. "Provided" is intended to be understood as meaning in particular specially designed and/or equipped.

In particular if the exhaust gas guiding module is provided for forming an exhaust gas inlet or an exhaust gas outlet, a high degree of flexibility in respect of an arrangement of the exhaust gas aftertreatment device can be achieved. By means of the configuration as an exhaust gas inlet or exhaust gas outlet, a structural adaptation of the housing to different exhaust gas systems can be dispensed with. Different locations at which the exhaust gas flow is introduced into the housing or is discharged from the housing can be realized in a simple manner by the exhaust gas guiding module being inserted into the receptacle positioned most favourably in each case. By one housing being able to be provided for different exhaust gas systems, a high uniformity of components for different exhaust gas systems can be increased, as a result of which costs can be reduced. An "exhaust gas system" is intended to be understood here as meaning a system, which is connected to the internal combustion, for guiding the exhaust gas flow.

In a particularly preferred refinement, the housing has at least two exhaust gas chambers which are separated from each other and in which the at least two receptacles at least engage. In conjunction with such a refinement of the housing and of the receptacles, the exhaust gas guiding module can be designed in a particularly simple manner in terms of structure while at the same time the structural adaptation of the AGN modules to a special configuration of the receptacles can be dispensed with. "Separated exhaust gas chambers" are intended to be understood here as meaning in particular a separation into an inlet side and an outlet side, wherein the AGN modules is arranged in terms of flow between the two exhaust gas chambers which are separated from each other.

Furthermore, it is proposed that the exhaust gas guiding module has an outer opening for the connection of the exhaust gas system. As a result, the exhaust gas system can simply be connected to the exhaust gas guiding module. An "outer opening" is intended to be understood here in particular as meaning an opening which, when the exhaust gas system is removed, opens one of the exhaust gas chambers toward the surroundings. An "inner opening" is intended, by contrast, to be understood as meaning an opening which, in conjunction with a subsection of the exhaust gas guiding tube that is provided for guiding the exhaust gas flow, connects the outer opening to one of the exhaust gas chambers.

In addition, it is proposed that the exhaust gas guiding module has at least one inner opening which is provided for the connection in terms of flow to only one of the exhaust gas chambers. As a result, the exhaust gas guiding module can be provided simply for forming the exhaust gas inlet or the exhaust gas outlet. "Only" is intended to be understood here as meaning in particular that the exhaust gas guiding module all of the inner openings which the exhaust gas guiding module has are all provided for the connection in terms of flow to the same exhaust gas chamber.

In a particularly advantageous refinement, the exhaust gas aftertreatment device comprises at least one fastening means which is provided for fixing the exhaust gas guiding module in the receptacle. By use of a fastening means which is adapted to the receptacle, fixing of the exhaust gas guiding module in the receptacle can be realized in a particularly simple manner. In particular, it is thereby possible that structural modifications of the housing, in particular of the receptacles, can be dispensed with if the fastening means for the exhaust gas guiding module corresponds to fastening means which are provided for fixing the AGN modules.

In a particularly advantageous development, the exhaust gas guiding module is provided in an unfastened state in order to be rotated in the receptacle. As a result, the flexibility in the connection of the exhaust gas system can be further increased. In particular, it is simply possible to connect the exhaust gas system in different fitting positions to the housing. Alternatively, however, it can also be provided that the exhaust gas guiding module can only be fastened in the receptacle in one or more angular positions defined, for example, by a form-fitting connection. By means of such a configuration, a fixed angular position can be provided for a connection between the exhaust gas system and the exhaust gas guiding module. For the alignment of the exhaust gas system or for the adaptation to an alignment of the exhaust gas system, the exhaust gas guiding module is merely rotated in the receptacle before subsequently being fixed in the receptacle by means of the fastening means. In particular different clamping fastenings are advantageous here as the fastening means since said clamping fastenings permit fixing in any fitting positions, such as, for example, by a clip or by means of U-shaped clamps. Alternatively, it is, however, also conceivable as the fastening means to provide a screw connection which, owing to a rotationally symmetrical arrangement, permits at least one fixing in different discrete angular positions.

In a possible refinement, it is proposed that the housing has at least two sides which have recesses for forming the receptacles. As a result, the flexibility can be increased further since it is thereby possible to attach the exhaust gas guiding module to both sides of the housing. If the housing has, on at least one further side at least one additional exhaust gas inlet stub and/or at least one exhaust gas outlet stub, the exhaust gas system can be connected to the housing on three different sides, as a result of which particularly great flexibility can be achieved. Alternatively, however, the housing can also only have one single side with a recess for forming the receptacles. An "exhaust gas outlet stub" and an "exhaust gas inlet stub" are intended here to be understood as meaning in particular stubs which are fixedly connected to the housing and are connected in terms of flow to one of the exhaust gas chambers and which are provided only for the connection of the exhaust gas system.

In addition, it is proposed that the exhaust gas aftertreatment device has at least one AGN module which is inserted into one of the receptacles and which connects the at least two exhaust gas chambers to each other in terms of flow.

In addition, as one aspect of the invention, an exhaust gas guiding module for an exhaust gas aftertreatment device according to the invention is proposed, which has a connecting flange which is provided for the connection to an exhaust gas system, and an exhaust gas guiding tube which is provided in order to be connected in terms of flow to only one exhaust gas chamber of the exhaust gas aftertreatment device.

Further advantages emerge from the description below of the figures. The figures illustrate an exemplary embodiment of the invention. The figures, the description of the figures and the claims contain numerous features in combination. A person skilled in the art will expediently also consider the features individually and combine them to form meaningful further combinations.

DETAILED DESCRIPTION OF THE INVENTION

Figure 1:
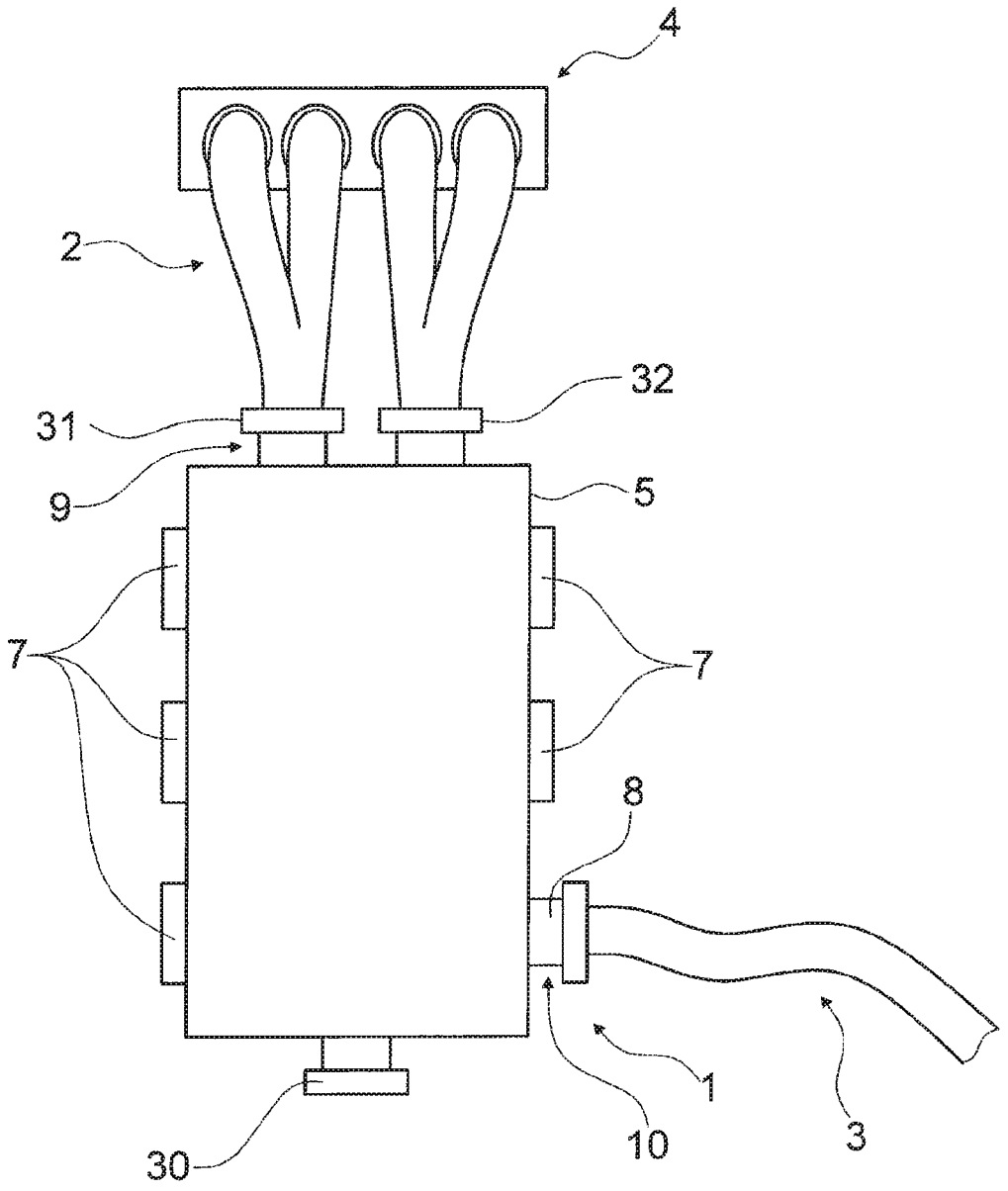
FIG. 1 shows a schematic illustration of an internal combustion engine with an exhaust gas system and an exhaust gas aftertreatment device.
Figure 2:
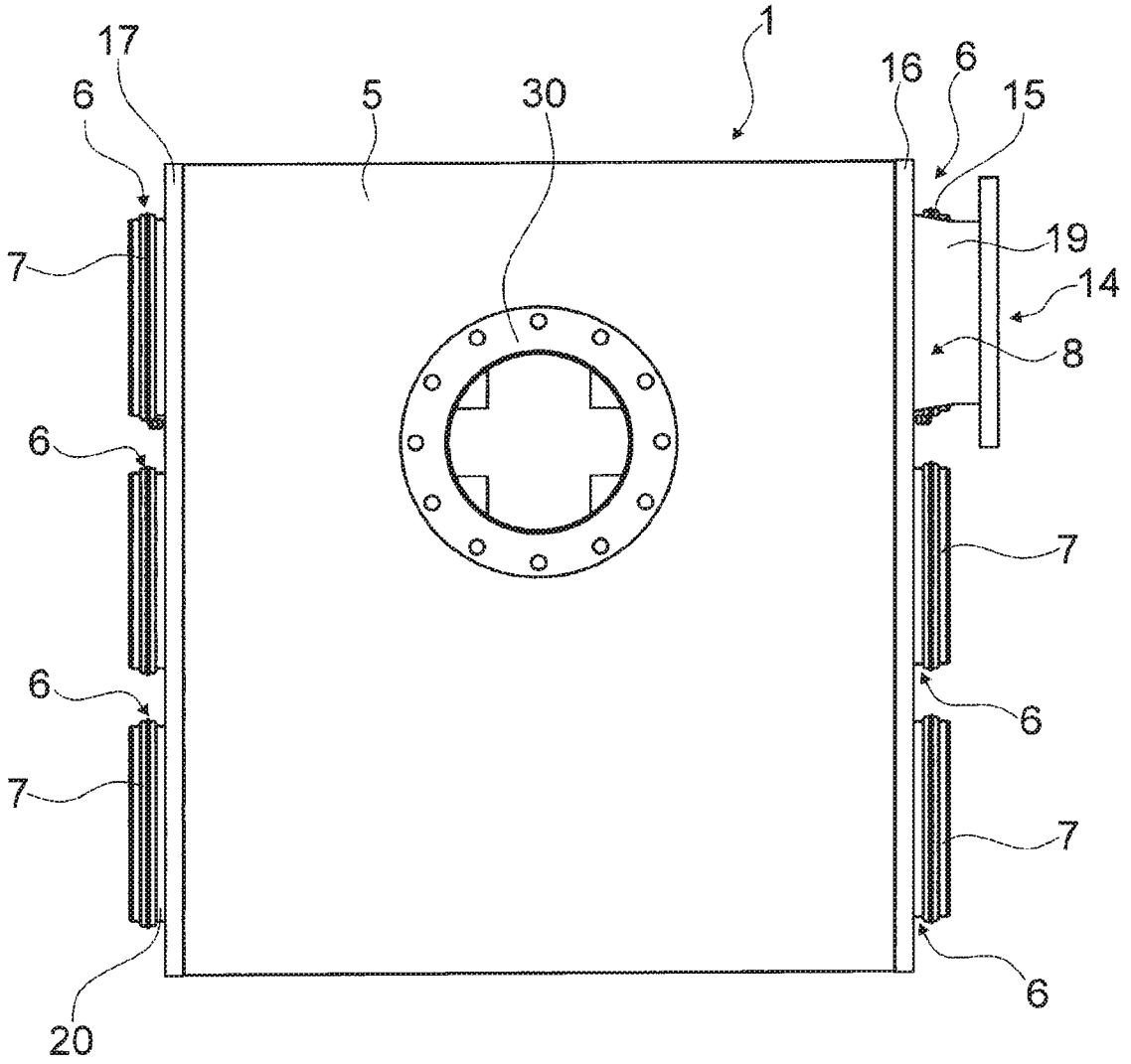
FIG. 2 shows the exhaust gas aftertreatment device with an inserted exhaust gas guiding module in a side view.
Figure 3:
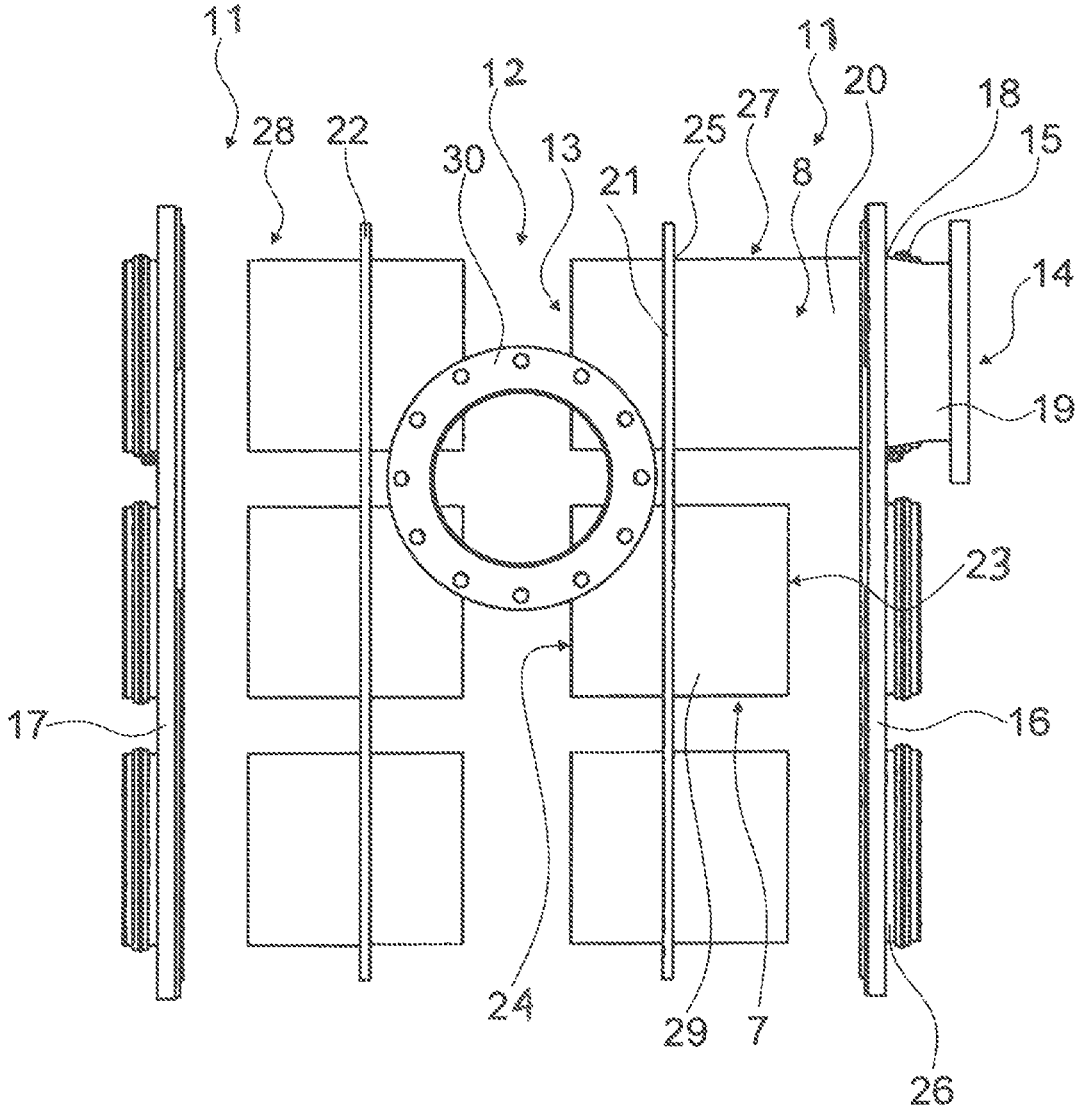
FIG. 3 shows the exhaust gas aftertreatment device with the housing removed.
Figure 4:
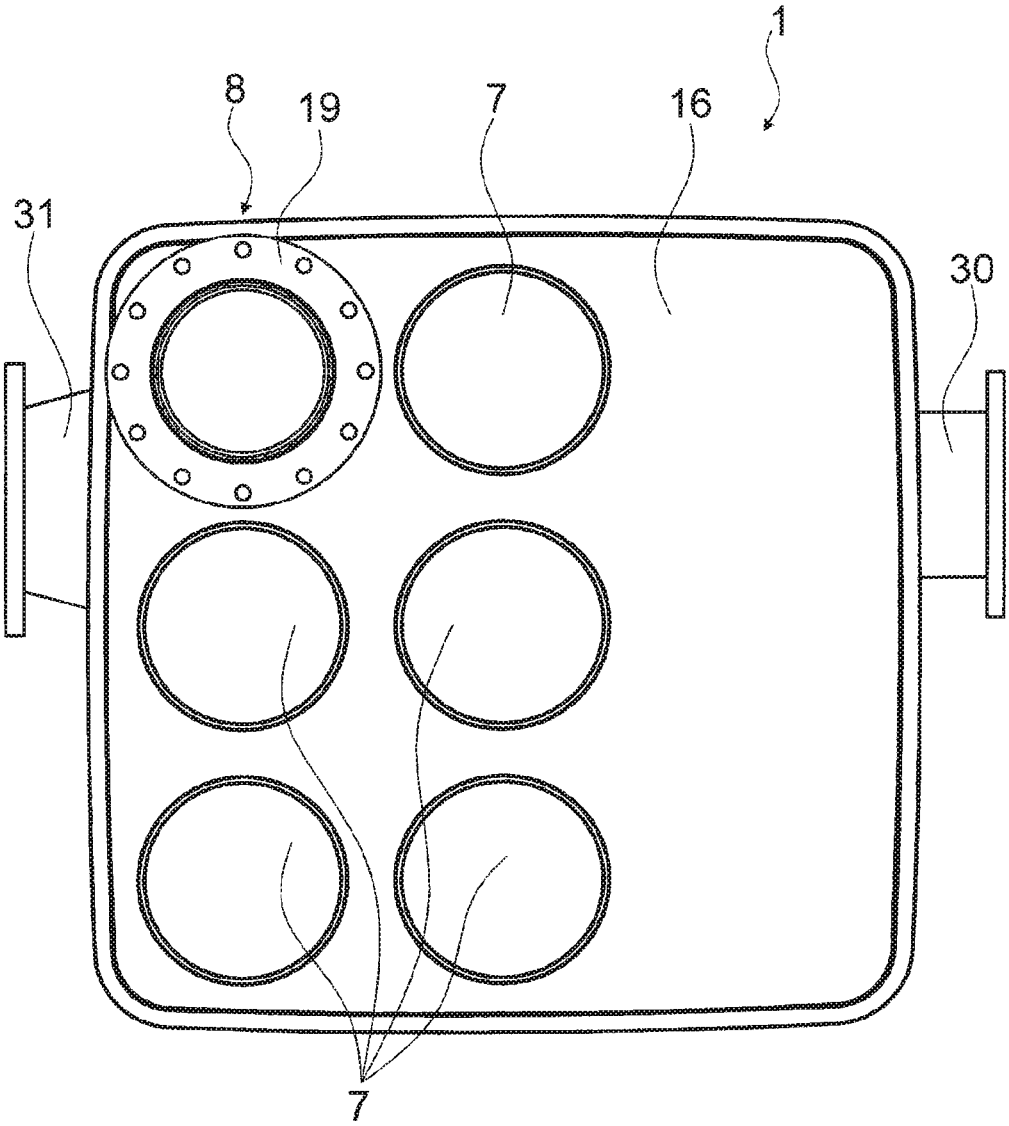
FIG. 4 shows a side view, which is rotated with respect to FIG. 1, of the exhaust gas aftertreatment device.

FIGS. 1 to 4 show an exhaust gas aftertreatment device 1 for an exhaust gas system 2, 3 of an internal combustion engine 4. The exhaust gas aftertreatment device 1 is provided for reducing pollutants in an exhaust gas of the internal combustion engine 4, for example by filtration or conversion. In order to reduce the pollutants, the exhaust gas aftertreatment device 1 has a plurality of AGN modules 7 which are provided for filtration and/or catalytic conversion of the pollutants. Depending on the internal combustion engine 4 used, on an intended use and/or on other technical requirements, the AGN modules 7 can have different configurations. All of the AGN modules 7 of the exhaust gas aftertreatment device 1 are of identical design here and are connected in parallel in terms of flow. The AGN modules 7 can be designed, for example, as particle filter modules or as catalytic modules, such as in particular, as diesel particle filter modules, as diesel oxidation catalytic converter modules for reducing CO portions, as SCR catalytic converter modules for reducing nitrogen oxides or the like. In principle, further devices for exhaust gas aftertreatment can be connected upstream or downstream of the exhaust gas aftertreatment device 1 illustrated. For example, the further device (not illustrated specifically) for exhaust gas aftertreatment can form a particle filter if the device illustrated is designed as an SCR catalytic converter.

The AGN modules 7 are typically subject to wear. In order to be able to ensure operating capability of the exhaust gas aftertreatment device 1, the AGN modules 7 are removable. Depending on the configuration of the AGN modules 7, it can be provided here that the AGN modules 7 are replaced individually by new AGN modules 7. Alternatively, it is also conceivable for the AGN modules 7 to be refitted after cleaning. Each of the AGN modules 7 can be individually removed and exchanged here.

At least part of an exhaust gas flow which is ejected by the internal combustion engine 4 is guided through the AGN modules 7. For the arrangement of the AGN modules 7 in the exhaust gas flow, the exhaust gas aftertreatment device 1 comprises a housing 5 which has a plurality of receptacles 6 for the AGN modules 7. All of the receptacles 6 are of equivalent design, i.e. the AGN modules 7 can basically be inserted into any of the receptacles 6.

The housing 5 which is provided for conducting the exhaust gas flow through the AGN modules 7 has an exhaust gas inlet 9 and an exhaust gas outlet 10. Furthermore, the housing 5 comprises a plurality of intermediate walls 21, 22 which separate the housing 5 into two exhaust gas chambers 11, 12 which are separated from each other. The exhaust gas inlet 9 and the exhaust gas outlet 10 are respectively connected here to one of the exhaust gas chambers 11, 12. The receptacles 6, into which the AGN modules 7 are inserted in the state ready for operation, each engage in the two exhaust gas chambers 11, 12. In the state ready for operation, the AGN modules 7 connect the exhaust gas chambers 11, 12 to each other. The exhaust gas flow is introduced into the first exhaust gas chamber 11 by the exhaust gas inlet 9. In the first exhaust gas chamber 11, the exhaust gas flow is divided between the individuals AGN modules 7, is guided through the individual AGN modules 7 and is collected again in the second exhaust gas chamber 12. The exhaust gas flow is subsequently discharged again from the housing 5 via the exhaust gas outlet 10.

The housing 5 has two side walls 16, 17, into which a plurality of recesses 18 are introduced in order to form the receptacles 6 for the AGN modules 7. The receptacles 6 are thereby introduced on both sides into the housing 5. In principle, however, recesses 18 can also be provided only in one of the side walls 16, 17. At least a part of the intermediate walls 21, 22 which divide the housing 5 into the exhaust gas chambers 11, 12 are oriented parallel to the side walls 16, 17. Recesses 25 which, along an insertion direction for the AGN modules 7, are arranged congruently with the recesses 18 in the side walls 16, 17 are likewise introduced into the intermediate walls 21, 22 which are oriented parallel to the side walls 16, 17. The AGN modules 7, which can be inserted into the housing 5 from both sides in this exemplary embodiment, each engage at most by half in the housing 5. At the same time, they each engage at least in the two recesses 18, 25 of the corresponding receptacle 6.

In order to form the receptacle 6, the housing 5 can additionally have receiving tubes (not illustrated specifically) which are fixedly connected to the respective side wall 16, 17 and to the respective intermediate wall 21, 22. In such a refinement, the receptacles 6 are in each case formed by the two associated recesses 18, 25 and the associated receiving tube. In such a configuration, the receiving tubes are provided for connecting the two exhaust gas chambers 11, 12 to each other in terms of flow.

The first exhaust gas chamber 11 which is provided for the exhaust gas inlet 9 has two partial chambers 27, 28 which are each bounded along the insertion direction by one of the side walls 16, 17 and one of the intermediate walls 21, 22. The second exhaust gas chamber 12, which is provided for the exhaust gas outlet 10, is arranged along the insertion direction between the two partial chambers 27, 28 of the first exhaust gas chamber 12. The intermediate walls 21, 22 which bound the second exhaust gas chamber 12 separate the two exhaust gas chambers 11, 12 from each other along the insertion direction.

In the mounted state, i.e. when the AGN modules 7 are inserted into the receptacle 6, the AGN modules 7 reach through the corresponding intermediate wall 21, 22. The AGN modules 7 each have a Canning tube 29 for receiving a substrate, an inflow opening 23 for connection in terms of flow to the first exhaust gas chamber 11, and an outflow opening 24 for connection to the second exhaust gas chamber 12. The first exhaust gas chamber 11 and the second exhaust gas chamber 12 are connected to each other in terms of flow only via the AGN modules 7. The AGN modules 7 are provided in order to be connected to the respective side wall 16, 17, through which they are guided, so as to be fixed in the receptacles 6.

In the exemplary embodiment illustrated, a number of the mounted AGN modules 7 is smaller than a number of the receptacles 6 which the housing 5 has. The receptacles 6 are therefore only partially fitted with AGN modules 7. In addition to the AGN modules 7, the exhaust gas aftertreatment device 1 has an exhaust gas guiding module 8 which is inserted into the remaining receptacle 6 of the housing 5. The receptacle 6 into which the exhaust gas guiding module 8 is inserted is in principle also suitable for receiving a further AGN module 7. The exhaust gas guiding module 8 can therefore be inserted into any of the receptacles 6. An arrangement of the AGN modules 7 and of the exhaust gas guiding module 8 in the receptacles 6 can be changed as desired.

In the exemplary embodiment illustrated, the exhaust gas aftertreatment device 1 merely has the one exhaust gas guiding module 8. Alternatively, however, the exhaust gas aftertreatment device 1 may also have further exhaust gas guiding modules which are inserted instead of an AGN module 7 into one of the remaining receptacles 6. In principle, any number of the AGN modules 7 can be replaced by exhaust gas guiding modules 8.

In the exemplary embodiment illustrated, the exhaust gas guiding module 8 forms an exhaust gas outlet stub to which, for example, the exhaust gas system 3 can be connected for further guidance of the exhaust gas flow. In addition to the exhaust gas guiding module 8, which can be adapted in particular in respect of its positioning in one of the receptacles 6 in a flexible manner to the adjoining exhaust gas system 3, the housing 5 has a further exhaust gas outlet stub 30 to which the exhaust gas system 3 can be connected. Depending on requirements, the exhaust gas outlet stub 30 which has the housing 5, or the exhaust gas outlet stub formed by the exhaust gas guiding module 8 can therefore be used according to choice. If the exhaust gas outlet stub 30 of the housing 5 is used, the exhaust gas guiding module 8 can be omitted and instead a further AGN module 7 can be inserted into the receptacle 6. If the exhaust gas flow is discharged by means of the exhaust gas guiding module 8, the exhaust gas outlet stub 30 of the housing 5 can be closed.

The exhaust gas guiding module 8 has an inner opening 13 for connection in terms of flow to the second exhaust gas chamber 12, and an outer opening 14, for the connection of the exhaust gas system 3. The exhaust gas flow guided within the exhaust gas guiding module 8 is separated in terms of flow from the first exhaust gas chamber 11. During operation, the exhaust gas flow enters the exhaust gas guiding module 8 through the inner opening 13 and exits therefrom again through the outer opening 14.

The exhaust gas guiding module 8 has an exhaust gas guiding tube 20 and a connecting flange 19. The connecting flange 19 is provided for connecting the exhaust gas guiding module 8 fixedly to the housing 5. In addition, the connecting flange 19, which is provided for the connection of the exhaust gas system 3, forms the outer opening 14. The exhaust gas guiding tube 20 adjoins the connecting flange 19. the exhaust gas guiding tube 20 forms the inner opening 13 for the connection in terms of flow to the second exhaust gas chamber 12. Along the insertion direction, the exhaust gas guiding tube 20 has an extension length which is at least the same size as a corresponding extension of the partial chambers 27, 28 of the first exhaust gas chamber 11. In the mounted state, the exhaust gas guiding tube 20 passes completely through the corresponding partial chamber 27, 28 of the first exhaust gas chamber 11 and projects partially into the second exhaust gas chamber 12. The inner opening 13 is formed by a partial portion of the exhaust gas guiding tube 20, which partial portion projects into the second exhaust gas chamber 12.

For the fixing in the receptacle 6, the exhaust gas guiding module 8 has a fastening means 15 which is provided in particular in order to connect the connecting flange 19 and the exhaust gas guiding tube 20 fixedly to the housing 5. In the exemplary embodiment illustrated, the housing 5 has a plurality of holding tubes 26 which are each assigned to one of the receptacles 6. In the exemplary embodiment illustrated, the holding tubes 26 which are provided for the fastening of the AGN modules 7 and of the exhaust gas guiding module 8 each form a V-band flange. The fastening means 15 which is provided for fixing the exhaust gas guiding module 8 is designed as a V-band clip. The AGN modules 7 each have a similar or identical fastening means. The fastening means (not illustrated specifically in the exemplary embodiment) for the AGN modules 7 are likewise designed as V-band clips.

The exhaust gas guiding module 8 is provided in order to be rotated in an unfastened state of the receptacle 6. The connecting flange 19 of the exhaust gas guiding module 8 is of rotationally symmetrical design. In conjunction with the holding tube 26 of the corresponding receptacle 6, the connecting flange 19 merely defines an axis of rotation about which the exhaust gas guiding module 8 can be rotated as long as the latter is unfastened. The axis of rotation runs parallel here to the insertion direction. If a fitted position is defined for the exhaust gas guiding module 8, the exhaust gas guiding module 8 is fixed by means of the fastening means 15.

In addition to the exhaust gas outlet stub 30, the housing 5 has two further exhaust gas inlet stubs 31, 32 which is provided for the connection of the exhaust gas system 2 which connects the exhaust gas aftertreatment device 1 to the internal combustion engine 4. In the configuration of the exhaust gas guiding module 8 as an exhaust gas outlet, the exhaust gas flow enters the housing 5 of the exhaust gas aftertreatment device 1 via the exhaust gas inlet stubs 31, 32, is divided between the two partial chambers 27, 28 of the first exhaust gas chamber 11, passes via the AGN modules 7 into the second exhaust gas chamber 12 and exits again from the housing 5 via the exhaust gas guiding module 8. Alternatively, the exhaust gas guiding module 8 can form an exhaust gas inlet stub which can be used instead of the exhaust gas inlet stubs 31, 32 of the housing 5.

In a configuration as an exhaust gas inlet stub, the exhaust gas guiding module 8 is formed substantially analogously to the exemplary embodiment illustrated. In the configuration as the exhaust gas inlet stub, the inner opening 13 is provided for connection to the first exhaust gas chamber 11. The inner opening 13 is then arranged in a partial portion of the exhaust gas guiding tube 20 which, in the mounted state, passes through the first exhaust gas chamber 11. One end of the exhaust gas guiding tube 20 is closed here in a gas-tight manner, as a result of which the exhaust gas guiding tube 20 is provided for closing the corresponding recess 25 in the intermediate wall 21, 22 in a gas-tight manner.

The invention claimed is:

1. An exhaust gas aftertreatment device for an exhaust gas system of an internal combustion engine, comprising:

a housing that has at least two receptacles of equivalent design for arrangement of modules that guide at least part of an exhaust gas flow and include a substrate for exhaust gas aftertreatment; and, at least one exhaust gas guiding module inserted into one of the at least two receptacles, wherein the housing has at least two outer side walls that have recesses that form the receptacles, wherein the housing has a first exhaust gas chamber having two partial chambers and a second exhaust gas chamber arranged between the two partial chambers of the first exhaust gas chamber, the second exhaust gas chamber being separated from each of the partial chambers by a respective intermediate wall, wherein each of the at least two receptacles communicates with the second exhaust gas chamber and one of the partial chambers.

2. The exhaust gas aftertreatment device according to claim 1, wherein the exhaust gas guiding module forms an exhaust gas inlet or an exhaust gas outlet.

3. The exhaust gas aftertreatment device according to claim 1, wherein the exhaust gas guiding module has an outer opening for connection of the exhaust gas system.

4. The exhaust gas aftertreatment device according to claim 1, wherein the exhaust gas guiding module has at least one inner opening provided for connection in terms of flow to only one of the exhaust gas chambers.

5. The exhaust gas aftertreatment device according to claim 1, comprising fastening means for fixing the exhaust gas guiding module in the receptacle.

6. The exhaust gas aftertreatment device according to claim 1, wherein the exhaust gas guiding module is provided in an unfastened state for rotation in the receptacle.

7. The exhaust gas aftertreatment device according to claim 1, further comprising a connecting flange for connection to the exhaust gas system, and an exhaust gas guiding tube provided to be connected in terms of flow to only one of the exhaust gas chambers of the exhaust gas aftertreatment device.

8. An exhaust gas aftertreatment device for an exhaust gas system of an internal combustion engine, comprising:

a housing that has at least two receptacles of equivalent design for arrangement of modules that guide at least part of an exhaust gas flow and include a substrate for exhaust gas aftertreatment, wherein the housing has at least two exhaust gas chambers which are separated from each other and in which the at least two receptacles engage;

at least one exhaust gas guiding module inserted into one of the at least two receptacles, wherein the housing has a first exhaust gas chamber having two partial chambers and a second exhaust gas chamber arranged between the two partial chambers of the first exhaust gas chamber, the second exhaust gas chamber being separated from each of the partial chambers by a respective intermediate wall, wherein each of the at least two receptacles communicates with the second exhaust gas chamber and one of the partial chambers; and at least one further module which is inserted into another of the at least two receptacles so as to connect the at least two exhaust gas chambers to each other in terms of flow.

* * * * *